US008485480B2

(12) United States Patent
Bove

(10) Patent No.: US 8,485,480 B2
(45) Date of Patent: Jul. 16, 2013

(54) CABINET LEVELING DEVICE

(75) Inventor: Thomas A. Bove, Cincinnati, OH (US)

(73) Assignees: Adam Anthony Bove, Brooklyn, NY (US); Benjamin Thomas Bove, Cincinnati, OH (US)

( * ) Notice: Subject to any disclaimer, the term of this patent is extended or adjusted under 35 U.S.C. 154(b) by 0 days.

(21) Appl. No.: 12/351,396

(22) Filed: Jan. 9, 2009

(65) Prior Publication Data

US 2010/0176256 A1 Jul. 15, 2010

Related U.S. Application Data

(60) Provisional application No. 61/019,986, filed on Jan. 9, 2008.

(51) Int. Cl.
*F16M 11/24* (2006.01)

(52) U.S. Cl.
USPC ..... 248/188.2; 312/111; 312/247; 248/188.4

(58) Field of Classification Search
USPC ..... 312/111, 245, 247; 248/188.2, 346.05, 248/188.3, 188.4, 354.3
See application file for complete search history.

(56) References Cited

U.S. PATENT DOCUMENTS

| | | | | | |
|---|---|---|---|---|---|
| 2,680,326 | A | * | 6/1954 | Sultan | 248/188.4 |
| RE24,009 | E | | 5/1955 | Sitler | |
| 2,725,667 | A | * | 12/1955 | Ingarra | 248/188.4 |
| 2,927,666 | A | | 3/1960 | Braviak | |
| 2,930,665 | A | * | 3/1960 | Budai | 312/111 |
| 3,025,122 | A | | 3/1962 | Millman | |
| 3,487,598 | A | * | 1/1970 | Lopina | 52/126.4 |
| 3,746,417 | A | | 7/1973 | Sasnett | |
| 3,877,764 | A | | 4/1975 | Hillier, Jr. | |
| 3,885,361 | A | * | 5/1975 | De Schutter | 52/126.4 |
| 3,953,093 | A | | 4/1976 | Hero | |
| 4,301,636 | A | * | 11/1981 | Luria | 312/111 |
| 4,660,901 | A | | 4/1987 | Shimada | |
| 4,991,805 | A | * | 2/1991 | Solak et al. | 248/188.4 |
| 5,062,246 | A | * | 11/1991 | Sykes | 52/126.4 |
| 5,069,418 | A | * | 12/1991 | Jennings | 249/210 |
| 5,169,219 | A | * | 12/1992 | Obbink | 312/245 |
| 5,212,918 | A | | 5/1993 | Newhouse et al. | |
| 5,255,478 | A | | 10/1993 | Baranowski et al. | |
| 5,480,253 | A | * | 1/1996 | Ljungberg | 403/409.1 |
| 5,492,399 | A | | 2/1996 | Tillack | |
| 5,647,181 | A | * | 7/1997 | Hunts | 52/282.1 |
| 6,094,872 | A | * | 8/2000 | Ward et al. | 52/126.4 |
| 6,129,431 | A | | 10/2000 | Hansen, Jr. et al. | |
| 6,701,570 | B2 | * | 3/2004 | Henriott et al. | 16/29 |
| 7,780,128 | B2 | * | 8/2010 | Walsberg | 248/188.4 |
| 2006/0124810 | A1 | * | 6/2006 | Cotto | 248/188.4 |
| 2006/0248814 | A1 | * | 11/2006 | Chen et al. | 52/126.6 |
| 2008/0116330 | A1 | * | 5/2008 | Cotto | 248/188.4 |
| 2009/0026333 | A1 | * | 1/2009 | Lenzini | 248/188.2 |

OTHER PUBLICATIONS

Specialty Supplies, Inc. web site for cabinet levelers and fittings (www.specialtysupplies.com/cabinet-levelers-fittings) printed Feb. 6, 2009.

* cited by examiner

*Primary Examiner* — Bradley Duckworth
(74) *Attorney, Agent, or Firm* — Wood, Herron & Evans, LLP

(57) ABSTRACT

A cabinet leveling device has a first channel for receiving a first cabinet sidewall, a second channel for receiving a second cabinet sidewall, an intermediate section connecting said first and second channel, and an adjustable threaded member received through said intermediate section for providing leveling adjustability to said device.

12 Claims, 4 Drawing Sheets

CABINET LEVELING DEVICE

CROSS REFERENCE TO RELATED APPLICATIONS

This application claims priority to U.S. provisional patent application Ser. No. 60/019,986 filed on Jan. 9, 2008, the disclosure of which is expressly incorporated by reference herein in its entirety.

FIELD OF THE INVENTION

The present invention relates to a leveling device for leveling cabinetry and more particularly for levelling one or more units of base cabinetry.

BACKGROUND OF THE INVENTION

Proper installation of base cabinets is critical to the overall look, function and life of newly installed cabinets. Since the advent of modern cabinet fabrication techniques, cabinet installers have searched for better, faster, more convenient ways to install cabinets. Those experienced in the art, for many reasons, have relied on tapered, wooden shims to level, plumb and support base cabinets. There are numerous drawbacks associated with the use of shims. For example, they are cumbersome, they don't allow precise adjustment; and they require trial and error to use. They are very time-consuming and require the installer to work on his knees and elbows using a pry bar in one hand and a shim in the other. Shims absorb water which may wick up into the cabinets, causing damage and/or promoting the growth of mold.

Over the years, there have been many attempts to design a more functional, faster device to install (level and plumb) cabinets—one that would eliminate the use of wooden shims. The marketplace today is full of such leg-leveling devices. Examples of such devices include the various cabinet levelers available from Specialty Supplies, Inc. (www.specialtysupplies.com). Most of these devices achieve the desired results but they significantly increase installation time and angst. As a practical matter, the devices that are commercially available today are seldom used. They are difficult to use even for the most experienced installer and practically impossible for the average do-it-yourselfer homeowner.

The main reason professional installers do not like to use cabinet leveling devices is that they are very time consuming and difficult to work with. Most of these devices must be screwed to each inside corner of each cabinet and then adjusted individually while the cabinet is turned over on its top. The biggest problem with these devices that are attached to the inside of the cabinet carcass is that they are completely inaccessible from the outside of the cabinet. Thus, the cabinets are flipped over and set in place to evaluate if further adjustments need to be made. Most often repeated adjustments are necessary and require repeated removal and flipping of the cabinets in order to make these additional adjustments. The entire trial and error process is tedious, time-consuming and costly.

Another type of device that has been developed is disclosed in U.S. Patent Application Publication No. US2006/0124810 A1, naming Peter Cotto as inventor ("Cotto Publication"). While the device disclosed in the Cotto Publication has some advantageous features, it still suffers from numerous drawbacks, including the need for drilling access holes through the bottom shelf of the cabinet; the device is only accessible from the interior of the cabinet; it only levels one cabinet at a time; it requires removal of all internal shelving/drawers prior to installation; and it requires precise alignment with the drilled hole.

In spite of the many attempts to develop a better device and method, installers today still most frequently use tapered, wooden shims for installation. Yet they continue to seek a better, faster and more convenient solution that would get them off their knees and speed up the cabinet installation process. As described below, the present invention satisfies each of these needs in the art.

SUMMARY OF THE INVENTION

In accordance with the present invention, a novel device for cabinet installation has been developed. The device of the present invention is completely accessible from the outside of the cabinet, even when other cabinets are placed beside it. Additionally, it is easy to install and adjust with a standard Allen head tool. Adjustment is quick, easy and extremely precise. The device attaches to two adjacent cabinets with a pressure-fit and does not require screws or drilling of holes in the cabinet or flipping the cabinet over. Moreover, because the device is attached to two adjacent cabinets, it serves to level/plumb two cabinets at a time, which saves time and costs, as well as to space the cabinets. Because the device is easily accessible throughout the entire installation process from the outside of the cabinets, the ease of use and adjustment capabilities are remarkable.

In one embodiment, the leveling device of the present invention includes a first channel for receiving a first cabinet sidewall, a second channel for receiving a second cabinet sidewall, an intermediate section connecting the first and second channels, and an adjustable threaded member received through a threaded opening in the intermediate section for providing leveling adjustability to the device. The device may also include inward projections such as dimples in the first and/or second channels to provide a friction fit with cabinet sidewalls.

A variety of materials are suitable for making the leveling device of the present invention. These include aluminum, composite plastics, etc. Moreover, the material is something that should be workable with milling, extruding or stamping.

Because the sidewalls of cabinets vary from one manufacturer to another, the leveling device of the present invention is designed to fit the differing cabinet sidewall dimensions. The most standard dimension is ½" plywood, but other dimensions ranging from ⅜" to ⅝" to ¾" plywood may be accommodated.

BRIEF DESCRIPTION OF THE DRAWINGS

These and other features, aspects, and advantages of the present invention will become better understood with regard to the following description, appended claims and accompanying drawings wherein:

DETAILED DESCRIPTION

Figure 1:
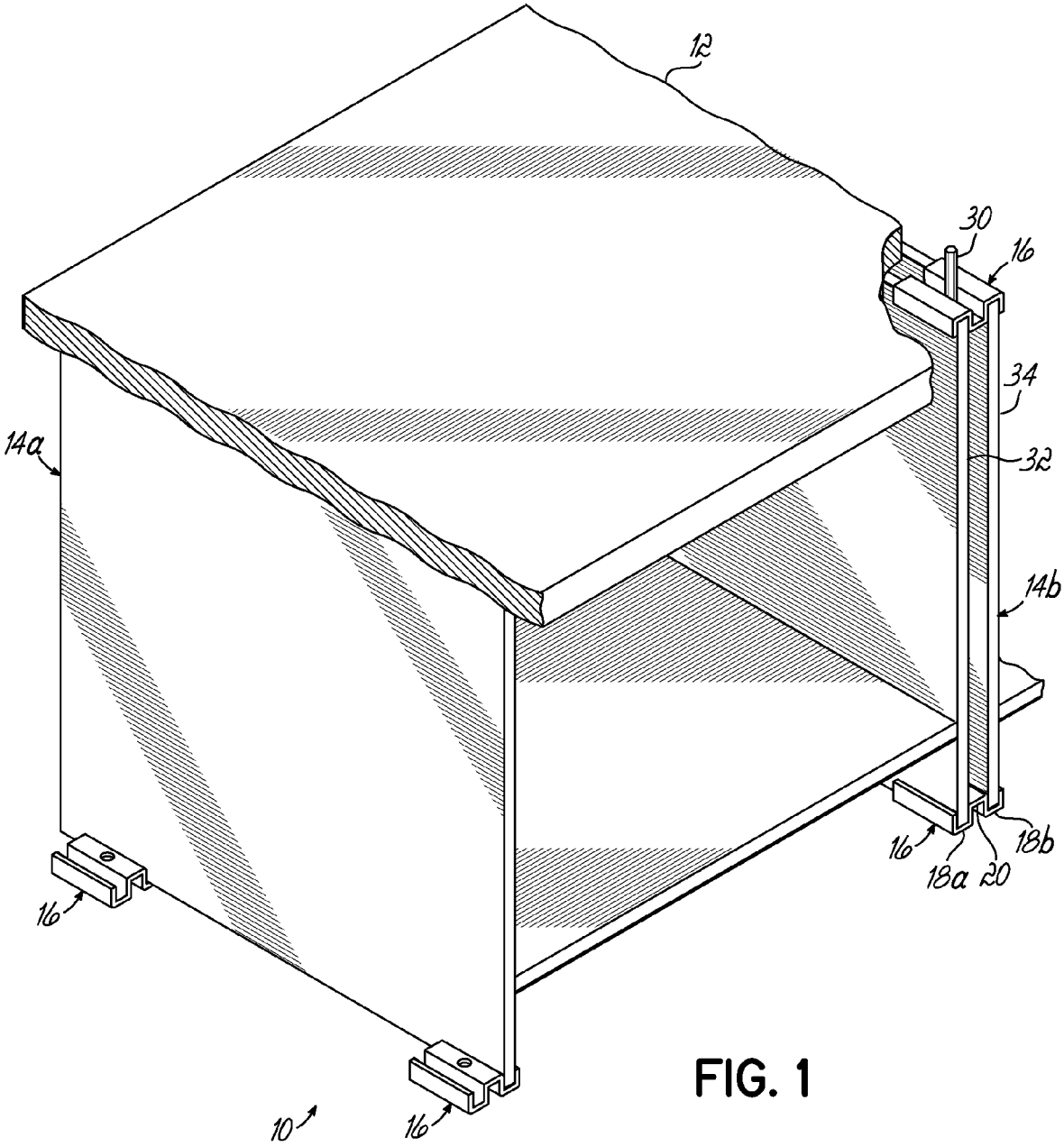
FIG. 1 is a perspective view, partially broken away, of a cabinet/counter combination showing the devices of the present invention in place.

Referring now to the drawings, FIG. 1 shows a portion of a run of base cabinets 10 of the type typically installed in homes and/or businesses and which are finished with a countertop 12. Based on the unevenness of the flooring upon which the base cabinets sit, it is necessary to provide leveling and plumbing of the cabinets 14 prior to installation of the countertop 12. In accordance with the present invention, several leveling devices 16 are shown in place in FIG. 1. As can be seen with reference to FIGS. 1 and 2, device 16 includes two channels 18A and 18B, along with an intermediate connecting section 20. Connecting section 20 has a threaded through hole 22 which receives an adjustable threaded member 24. Threaded member 24 preferably has a foot pad 26 at the base thereof which rests on the floor surface and a structure at the upper end thereof, such as an Allen-type female opening 28, for securing a turning device. While the device 16 is shown with an Allen-type female opening, other structures such as flat and Phillips head screw driver structures may also be used. Allen-type opening 28 receives the end of an Allen-type wrench 30 which is turned in the clockwise direction to raise the leveling device 16 relative to the floor 31. As shown in FIG. 1, the Allen wrench 30 is an elongated member which can be activated from the top of the base cabinets and is easily accessible between the side walls 32, 34 of two adjacent cabinets.

Figure 2:
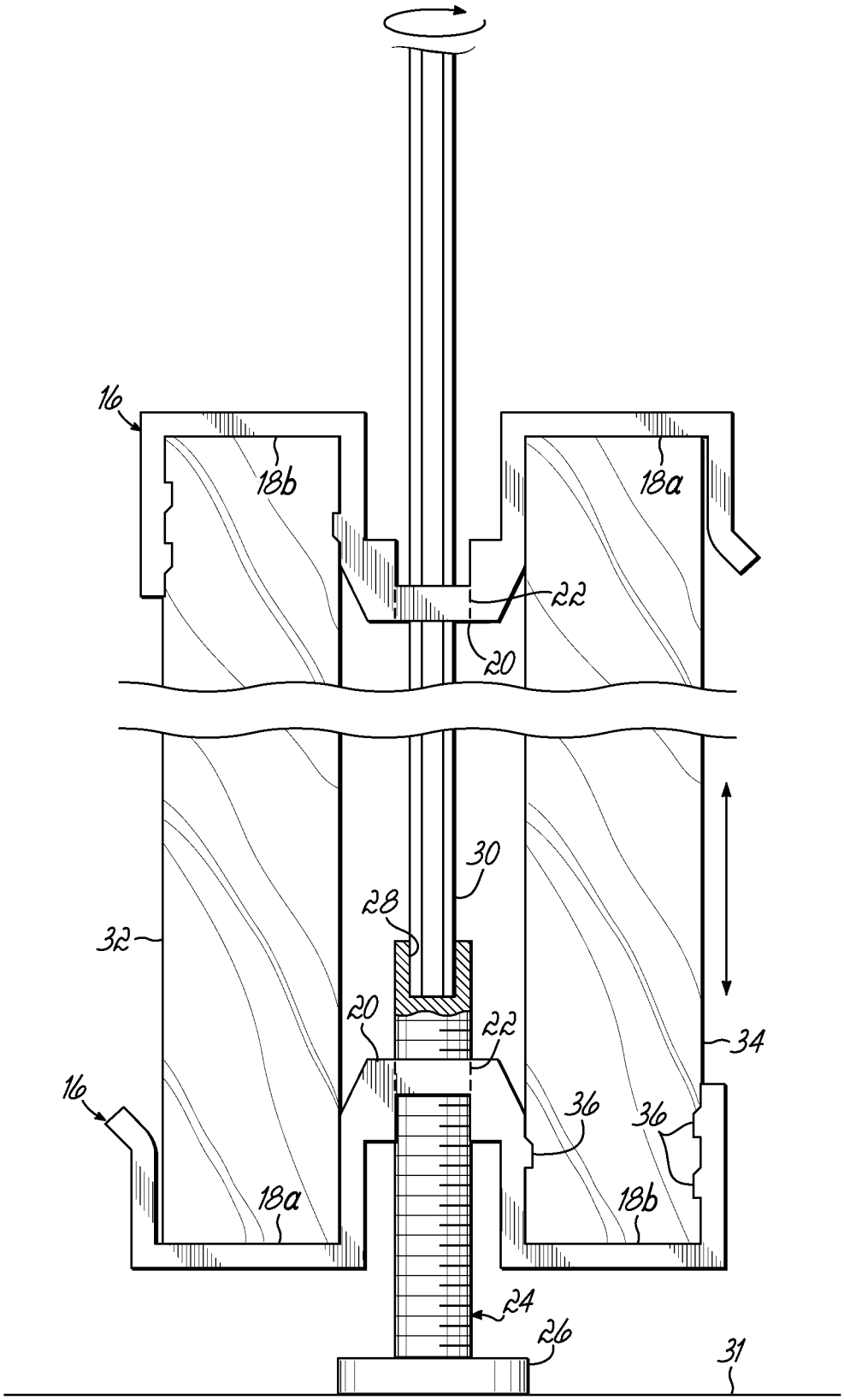
FIG. 2 is a front view of two adjacent cabinet walls with devices of the present invention in place.

As will be understood with reference to FIG. 1, by using the leveling device 16 of the present invention at each of the four corners of a cabinet 14 and by connecting two adjacent cabinets 14A, 14B, the device simplifies the process of leveling adjacent cabinets side-to-side and front-to-back to readily position the cabinets for receiving the installation of countertop 12. Based on the design of the device, the device 16 provides both a leveling action and a spacer action between the adjacent cabinet sidewalls 32 and 34. As shown in FIGS. 1 and 2, an inverted leveling device of the present invention may be used at the top of the cabinets to both retain them in position with the required spacing and to provide a guide hole for Allen wrench 30. It may be preferable to have the receiving channels 18A and 18B of slightly different dimensions. In that regard, as shown in FIG. 2, receiving channel 18A is slightly wider than receiving channel 18B. In addition, receiving channel 18B has inwardly extending projections such as "dimples" 36 to provide a strong friction fit to sidewall 34 of cabinet 14. By using a second leveling device 16 at the top edge of adjacent cabinets, the friction fit is on the adjacent sidewall 32 of cabinet 14 and thus both cabinets are rigidly secured together through the use of dual leveling devices 16. Device 16 may have inwardly extending projections such as dimples 36 in both channels 18A and 18B.

Figure 3:
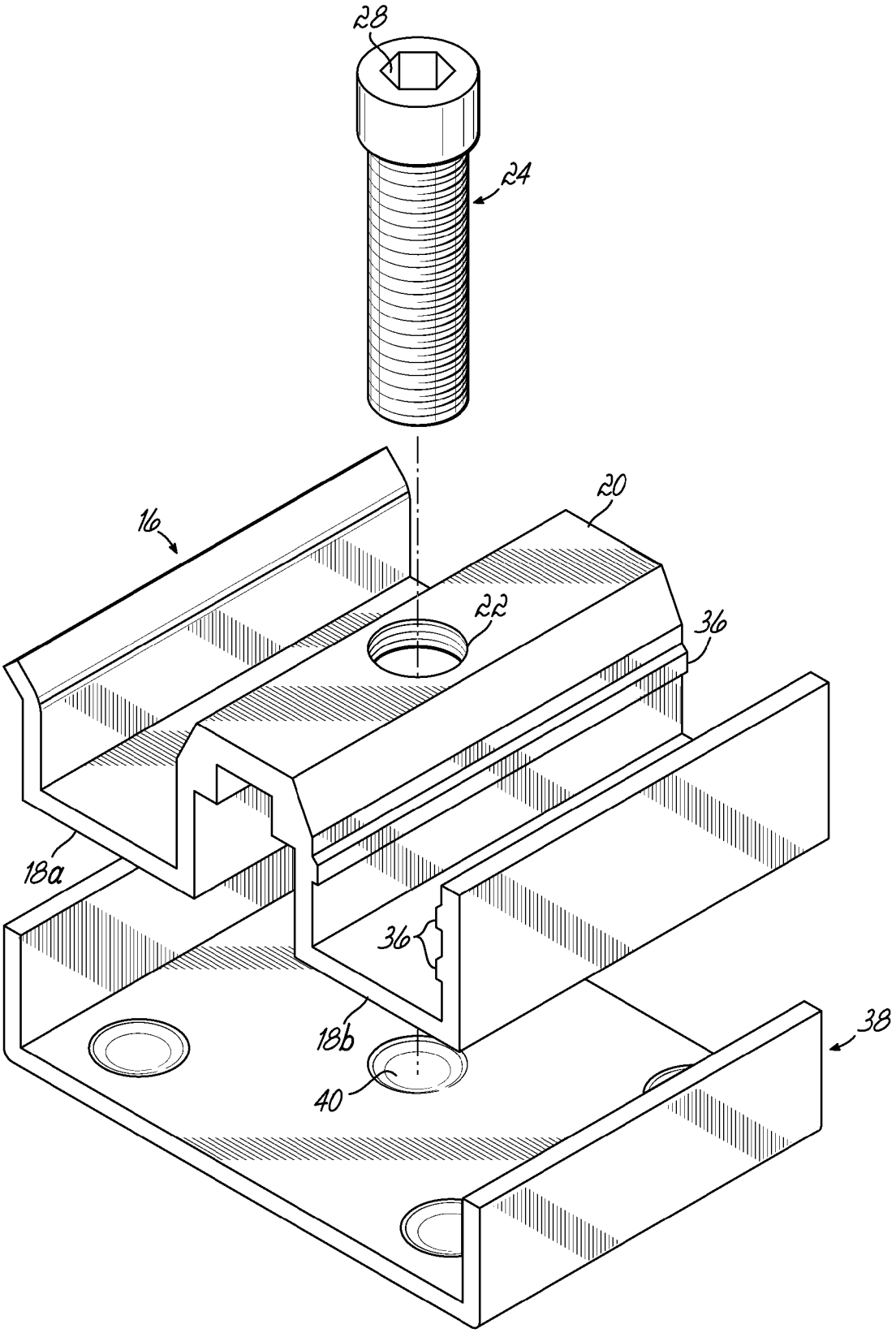
FIG. 3 is an exploded perspective view of an alternative embodiment of the present invention.

With reference to FIG. 3, there is shown an alternative embodiment of the present invention wherein threaded member 24 does not include a foot pad 26, but rather the device includes a separate component in the form of a base plate 38 which has indentations 40 for registering and receiving the distal end of threaded member 24.

Figure 4:
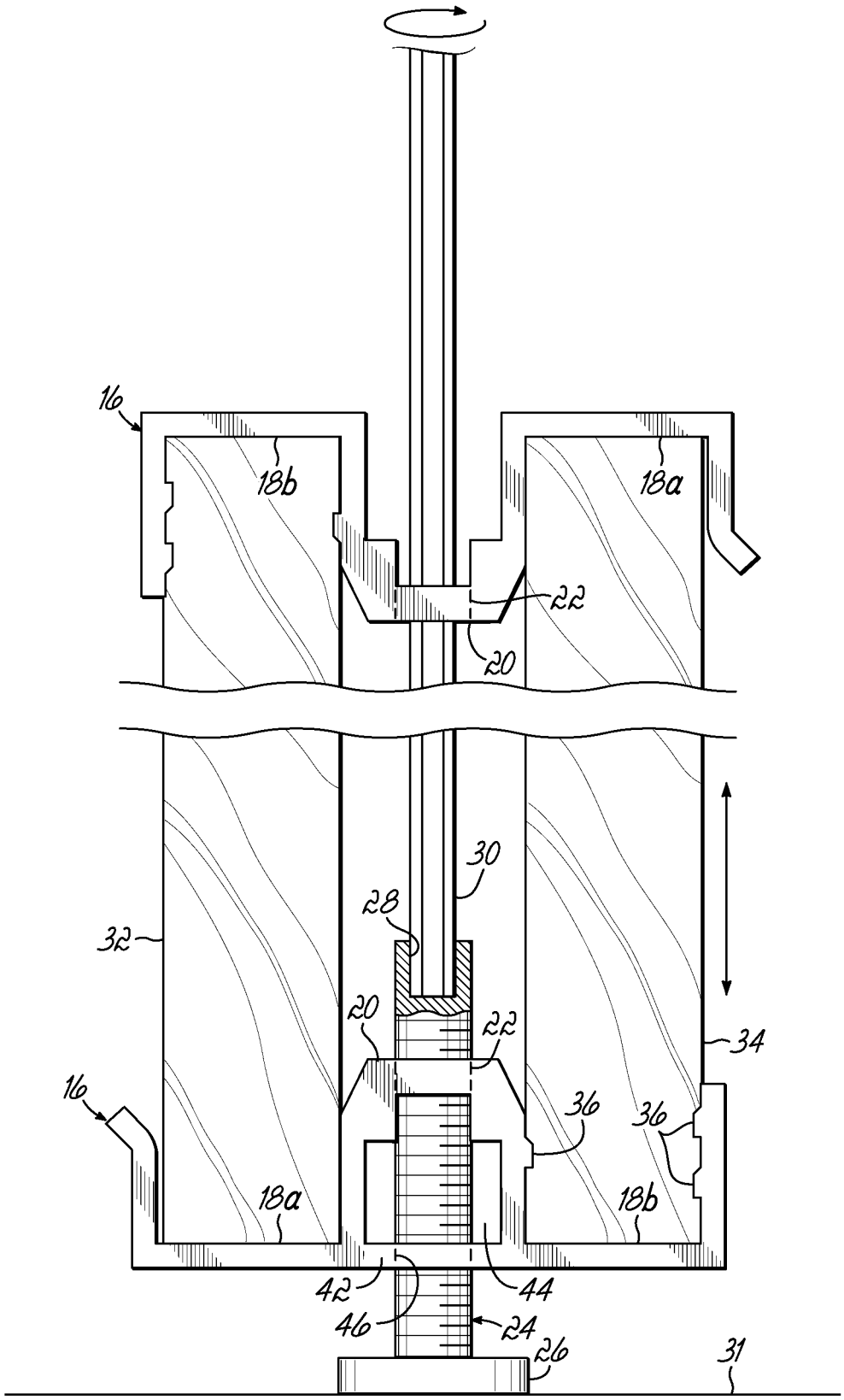
FIG. 4 is a front view of two adjacent cabinet walls with an alternative device embodiment in place at the bottom of the cabinet.

In an alternative embodiment, FIG. 4 shows a leveling device 16 in all respects the same as that shown in FIG. 2, but also including a base wall 42 that partially encloses cavity 44. Base wall 42 also includes threaded opening 46 for receiving threaded member 24 therethrough.

While the foregoing description has set forth preferred embodiments of the present invention in particular detail, it must be understood that numerous modifications, substitutions and changes can be undertaken without departing from the true spirit and scope of the present invention as defined by the ensuing claims. The invention is therefore not limited to specific embodiments as described but is only limited as defined by the following claims.

What is claimed is:

1. A leveling device to level first and second adjacent cabinets to a floor and to join the first and second cabinets together, comprising:

a first channel defined between generally parallel interior and exterior walls, and including a bottom wall connecting the interior and exterior walls, the first channel being sized to receive the entire width of a first cabinet sidewall lower edge of the first cabinet;

a second channel defined between generally parallel interior and exterior walls, and including a bottom wall connecting the interior and exterior walls, the second channel being sized to receive the entire width of a second cabinet sidewall lower edge of the second cabinet, the second channel being parallel with the first channel, and the first and second channels being free of projections extending upwardly from the bottom walls;

an intermediate section connecting said first and second channel; and an adjustable threaded member oriented substantially perpendicular to the floor in use, said adjustable threaded member received through a threaded opening in said intermediate section and including a structure at the upper end thereof for receiving a turning device to provide rotational adjustment of said threaded member, said structure for receiving a turning device being accessible from above said intermediate section, and wherein said adjustable threaded member provides leveling adjustability to said device by facilitating the raising and lowering of said channels.

2. The leveling device of claim 1, wherein at least one of said first and second channels includes inward projections to provide a friction fit with a cabinet sidewall.

3. The leveling device of claim 1 wherein said adjustable threaded member has a foot pad at the base thereof.

4. The leveling device of claim 1 wherein said structure for receiving a turning device is a female Allen-type opening.

5. The leveling device of claim 1 wherein said interior walls of said first and second channels and said intermediate section define an interior cavity.

6. The leveling device of claim 5 further comprising a base wall for partially enclosing said interior cavity.

7. The leveling device of claim 6 wherein said base wall has a threaded opening therethrough for receiving said threaded member.

8. The leveling device of claim 1, wherein said intermediate section is positioned between the first cabinet sidewall and the second cabinet sidewall in use.

9. The leveling device of claim 1, wherein said upper end of said threaded member is positioned above said intermediate section.

10. A leveling device for installing with first and second cabinets on a floor and for joining the first and second cabinets together and maintaining the space therebetween, the leveling device comprising:

a first channel defined between generally parallel interior and exterior walls, and including a bottom wall connecting the interior and exterior walls, the first channel being sized to receive the entire width of a first cabinet sidewall lower edge of the first cabinet;

a second channel defined generally parallel interior and exterior walls, and including a bottom wall connecting the interior and exterior walls, the second channel being sized to receive the entire width of a second cabinet sidewall lower edge of the second cabinet; the second channel being parallel with the first channel, and the first and second channels being free of projections extending upwardly from the bottom walls;

an intermediate section connecting said first and second channel and situated between the first cabinet sidewall and second cabinet sidewall; and an adjustable threaded member for providing leveling adjustability to said device by facilitating the raising and lowering of said channels, said adjustable threaded member being oriented substantially perpendicular to the floor, being received through a threaded opening in said intermediate section, and extending above said intermediate section.

11. A cabinet assembly situated on a floor in a room, comprising:

a first cabinet having a first cabinet sidewall, said first cabinet sidewall having a lower edge, a second cabinet adjacent the first cabinet and having a second cabinet sidewall, said second cabinet sidewall having a lower edge, and a leveling device for leveling the first and second cabinets to the floor and for joining the first and second cabinets, said leveling device comprising a first channel, including a bottom wall, for receiving the entire width of said first cabinet sidewall lower edge; a second channel, including a bottom wall, for receiving the entire width of said second cabinet sidewall lower edge, the first and second channels being free of projections extending upwardly from the bottom walls; an intermediate section connecting said first and second channel; and an adjustable threaded member for facilitating the raising and lowering of said first and second channels, the threaded member being oriented substantially perpendicular to the floor, received through a threaded opening in said intermediate section, and including a structure at the upper end thereof for receiving a turning device to provide rotational adjustment thereof, said structure for receiving a turning device being accessible from above said intermediate section and between said first cabinet sidewall and said second cabinet sidewall.

12. The cabinet assembly of claim 11 wherein the leveling device supports the lower edges of the first and second cabinet sidewalls above the floor.

* * * * *

UNITED STATES PATENT AND TRADEMARK OFFICE

CERTIFICATE OF CORRECTION

PATENT NO. : 8,485,480 B2
APPLICATION NO. : 12/351396
DATED : July 16, 2013
INVENTOR(S) : Thomas A. Bove It is certified that error appears in the above-identified patent and that said Letters Patent is hereby corrected as shown below:

In the Claims:

| | | |
|---|---|---|
| CLAIM 10<br>Column 4, line 62<br>"...a second channel defined generally parallel..." | should read | --...a second channel defined between generally parallel...-- |

Signed and Sealed this
Twenty-ninth Day of April, 2014

Michelle K. Lee

Michelle K. Lee
*Deputy Director of the United States Patent and Trademark Office*